US005435691A

United States Patent [19]

Braun et al.

[11] Patent Number: 5,435,691

[45] Date of Patent: Jul. 25, 1995

[54] AGGREGATE FOR FEEDING FUEL FROM SUPPLY TANK TO INTERNAL COMBUSTION ENGINE OF MOTOR VEHICLES

[75] Inventors: Hans-Peter Braun, Rottenburg; Willi Strohl, Beilstein, both of Germany

[73] Assignee: Robert Bosch GmbH, Stuttgart, Germany

[21] Appl. No.: 147,986

[22] Filed: Nov. 5, 1993

[30] Foreign Application Priority Data

Feb. 13, 1993 [DE] Germany ..... 43 04 334.8

[51] Int. Cl.[6] ..... F01D 1/12; F02M 37/04

[52] U.S. Cl. ..... 415/55.6; 417/244; 123/509

[58] Field of Search ..... 123/495, 516, 509; 417/244; 415/55.5, 55.6, 55.7

[56] References Cited

U.S. PATENT DOCUMENTS

| | | | |
|---|---|---|---|
| 3,614,256 | 10/1971 | Siegharten | 415/55.6 |
| 3,694,101 | 9/1972 | Rumsey | 415/55.7 |
| 4,653,979 | 3/1987 | Schillinger | 415/55.6 |
| 4,718,827 | 1/1988 | Sutton | 417/244 |
| 4,844,621 | 7/1989 | Umemura | 415/55.5 |
| 4,978,277 | 12/1990 | Moore | 415/55.6 |
| 5,149,252 | 9/1992 | Tuckey | 415/55.7 |

FOREIGN PATENT DOCUMENTS

| | | | |
|---|---|---|---|
| 3500139 | 10/1986 | Germany . | |
| 0190191 | 8/1986 | Japan | 425/55.6 |
| 0256868 | 10/1990 | Japan | 123/509 |
| 2134598 | 8/1984 | United Kingdom | 415/55.6 |

*Primary Examiner*—Carl S. Miller
*Attorney, Agent, or Firm*—Michael J. Striker

[57] ABSTRACT

Aggregate for feeding fuel from a supply tank to an internal combustion engine of a motor vehicle, has a multi-stage feed pump including a pre-feeding pump stage and at least one subsequent feeding pump stage located at the pre-feeding pump stage as considered in a feeding direction. The pre-feeding pump stage has a rotatably driven feeding element provided with at least one feeding member and is formed so that it feeds fuel with the use of a dynamic pressure effect in at least one feeding member. The feeding member is open in a peripheral direction of the feeding element.

14 Claims, 3 Drawing Sheets

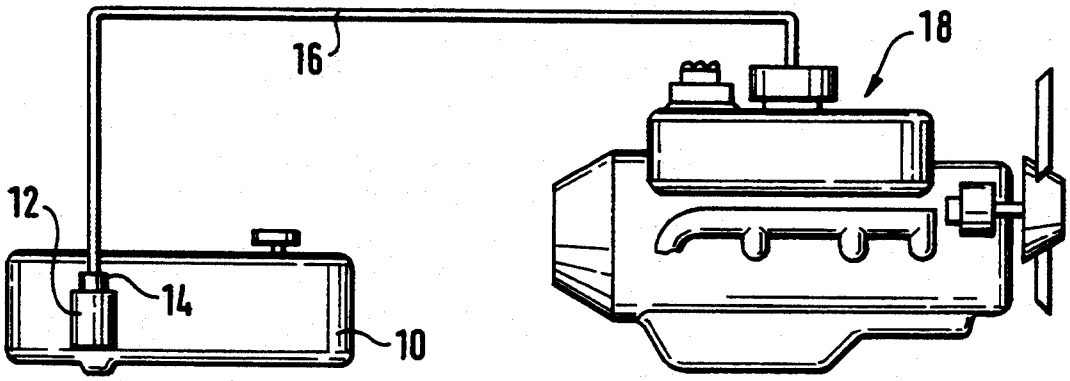
FIG. 1
FIG. 2
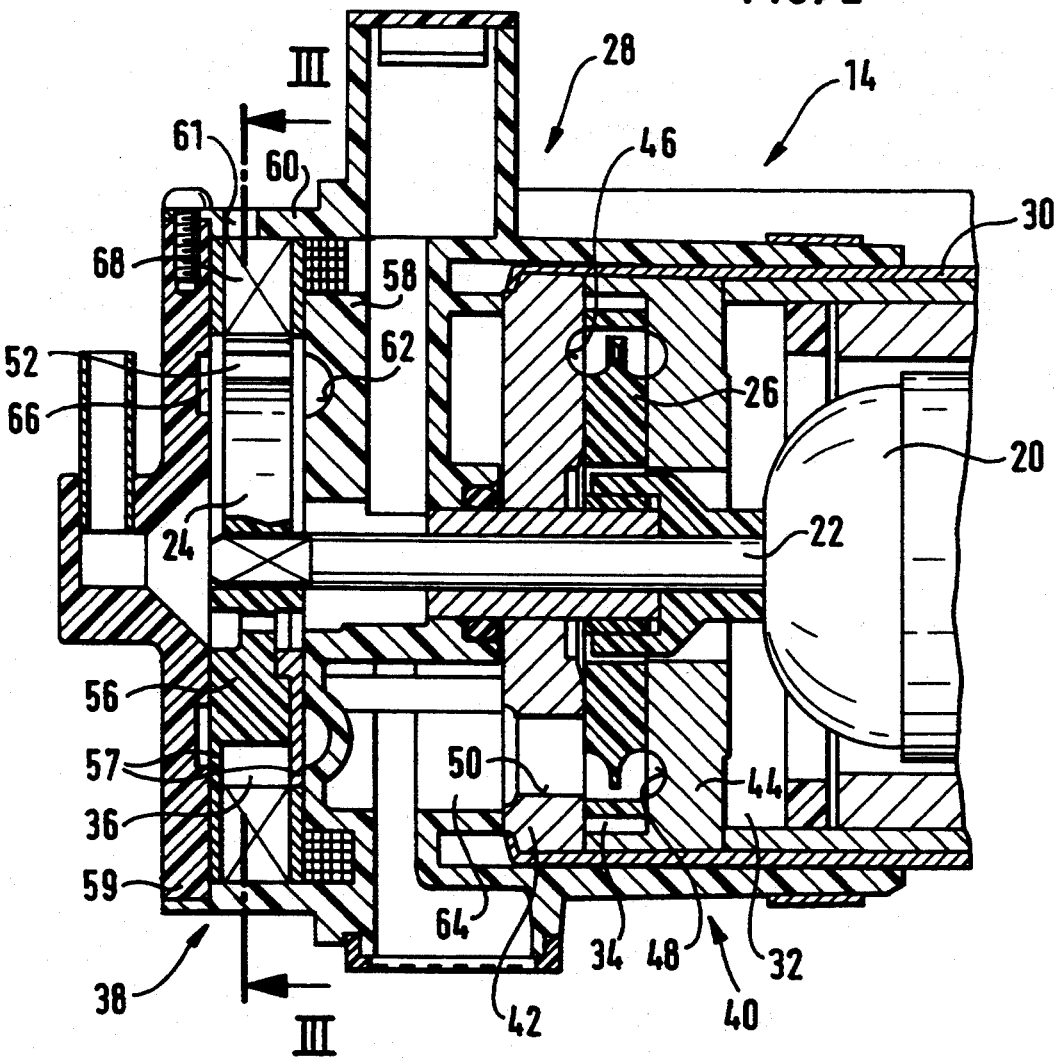

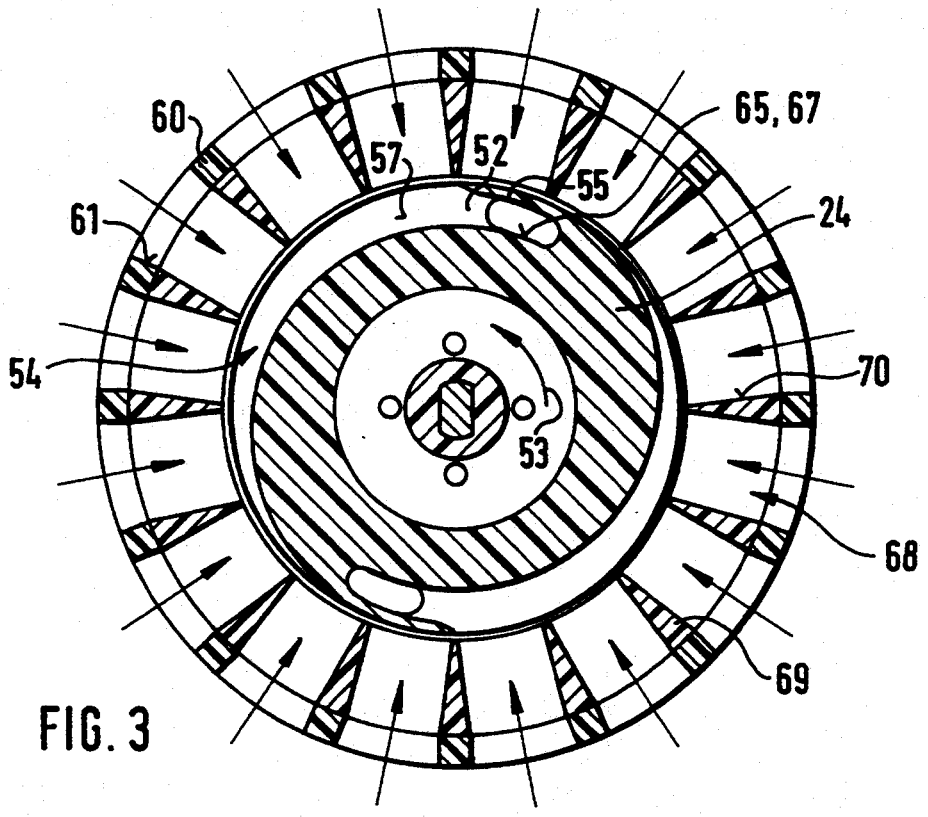
FIG. 3
FIG. 4
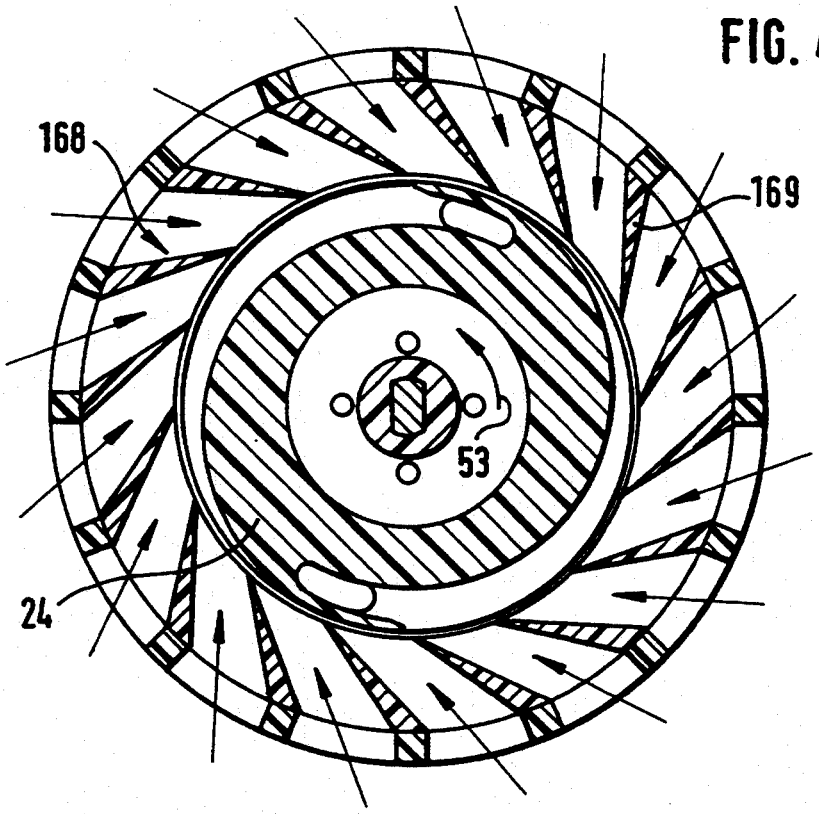

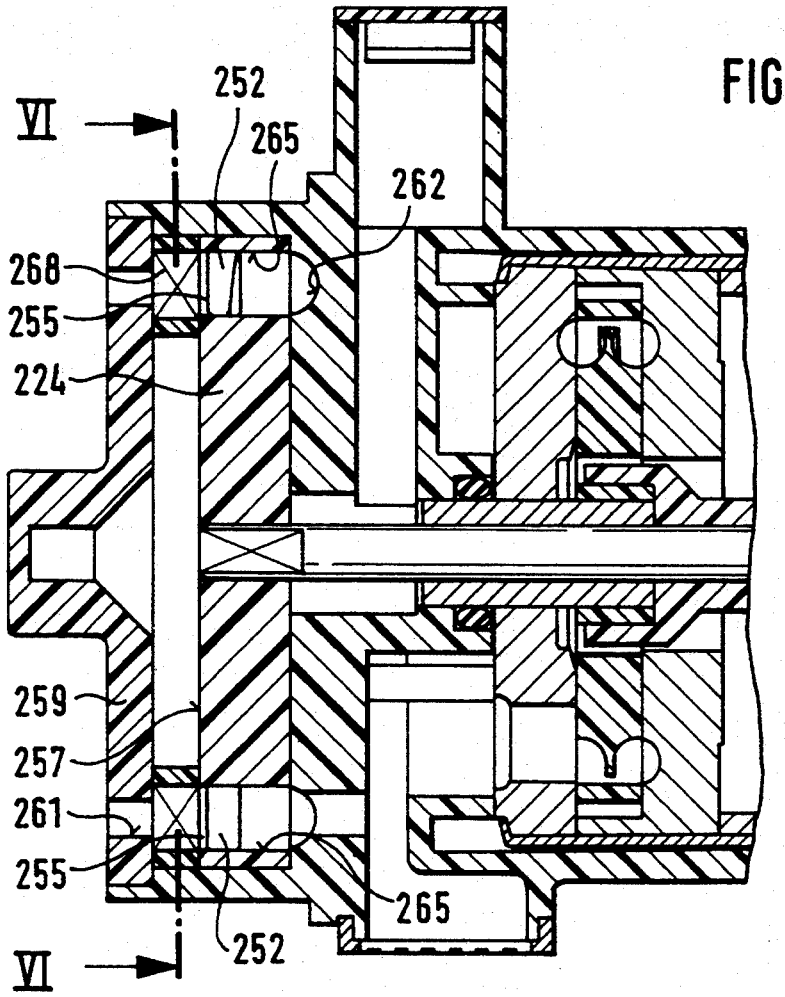
FIG. 5
FIG. 6
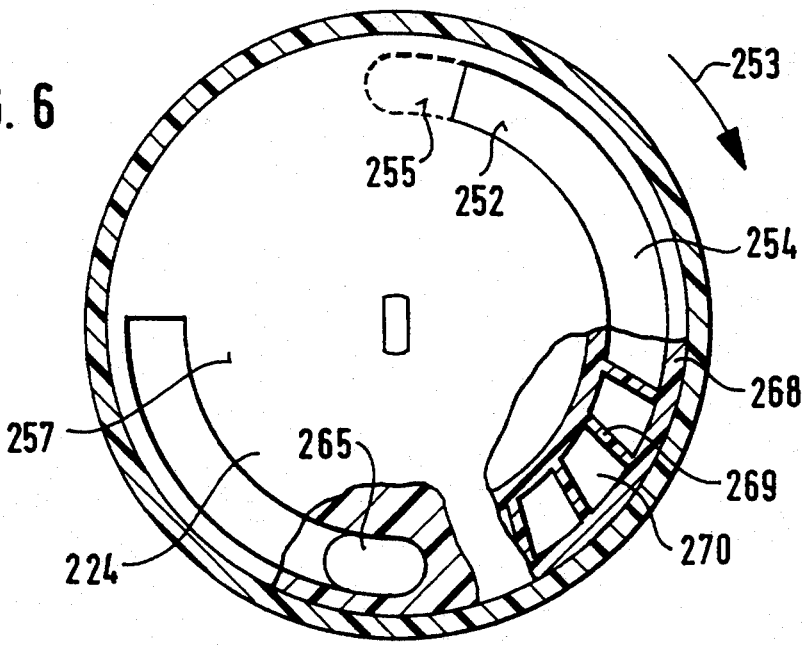

AGGREGATE FOR FEEDING FUEL FROM SUPPLY TANK TO INTERNAL COMBUSTION ENGINE OF MOTOR VEHICLES

BACKGROUND OF THE INVENTION

The present invention relates to an aggregate for feeding fuel from a supply tank of an internal combustion engine for a motor vehicle.

SUMMARY OF THE INVENTION

Such a feeding aggregate is disclosed for example in the German document DE 35 00 139 A. The feeding aggregate has a multi-stage feed pump with a flow pump stage formed as a pre-feeding pump stage and a gerotor pump stage following the first mentioned stage in a feeding direction. In the fuel pumps stage, the pressure in the region of the suction opening in the feeding fuel drops under the atmospheric pressure and thereby the formation of the gas bubbles is caused. This pressure drop is produced mainly since the fuel at the suction point must be accelerated to the suction speed. At high fuel temperatures reduce the gas bubbles produced by the pressure drop reduce the quantity of the feeding medium in the flow pump stage. The gas bubbles supplied to the following gerotor pump stage affect its feeding quantity, so that as a whole the operation of the feeding aggregate is affected at high fuel temperatures.

SUMMARY OF THE INVENTION

Accordingly, it is an object of the present invention to provide a feeding aggregate of the above mentioned type which avoid the disadvantages of the prior art.

In keeping with these objects and with others which will become apparent hereinafter, one feature of the present invention resides, briefly stated, in an aggregate for feeding fuel from a supply tank to an internal combustion engine of a motor vehicle, in which the pre-feeding pump stage feeds fuel with the use of the dynamic pressure effect in at least one feeding member, and the feeding member is open in the peripheral direction of the rotatable feeding element of the pre-feeding pump stage.

When the feeding aggregate is designed in according to the present invention, the pre-feeding pump stage operating in accordance with the dynamic pressure principle produces no negative pressure since it does not aspirate the feeding fuel but instead pumps it in at least one member of the feeding element, so that the feeding member cannot form a negative pressure.

In accordance with another feature of the present invention, the feeding element at its end side located opposite to the feeding passage adjoins a housing part with a ring-shaped passage, and the feeding element has an opening which connects its feeding member with the passage. In this construction, the feeding element is pressure compensated, so that no force in direction of the rotary axis is produced.

In accordance with a further feature of the patent invention, the feeding element at its outer periphery is surrounded by a guiding grate preventing a tangential flow movement of the fuel surrounding the feeding element. Also, the guiding grate can be arranged between the end side of the feeding member and the housing part. The guiding grate prevents a rotation of the fuel which surrounds the feeding elements under the action of a drag.

The guiding member can be formed as a substantially U-shaped depression on the outer periphery of the feeding element and extend substantially tangentially on the feeding element. In this construction no additional structural part is needed for forming the guiding grate.

An in-flow region located before the depression can be provided in a peripheral direction of the feeding element and then expanding spirally relative to the axis of rotation of the feeding element. In this construction a flow-favorable course of the in-flow in the feeding member is obtained.

Finally, the feeding element can be formed as a multi-part element and at least the central region and a lateral portion can be formed as separate parts. The thusly designed multi-part feeding element can be easily produced since its individual parts have no undercut.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a view schematically showing a fuel supply tank, a fuel feeding aggregate and an internal combustion engine;

FIG. 2 is a view showing the fuel feeding aggregate on a larger scale partially in a longitudinal section, in accordance with the first embodiment;

FIG. 3 is view showing a section through the fuel feeding aggregate with a guiding grate, taken along the line III—III in FIG. 2;

FIG. 4 is a view of a variant of the guiding grate in a section taken along the line III—III;

FIG. 5 is a view showing a fuel feeding aggregate in a section in a longitudinal direction, in accordance with the second embodiment of the present invention; and FIG. 6 is a view showing a section of the fuel feeding aggregate taken along the line VI—VI in FIG. 5.

DESCRIPTION OF THE PREFERRED EMBODIMENTS

As can be seen from FIG. 1 a fuel feeding aggregate 14 is arranged in a fuel supply tank 10. A pressure conduit 16 is connected with the pressure side of the fuel feeding aggregate and leads to an internal combustion engine 18 of the motor vehicle. During the operation of the internal combustion engine the fuel feeding aggregate 14 sucks fuel from the supply tank 10 and feeds it to the internal combustion engine 18.

The fuel feeding aggregate 14 is shown in FIGS. 2–6 on an enlarged scale. It has an electrical drive motor 20 with a drive or armature shaft 22 connected with feeding elements 24 and 26 of a multi-stage feed pump 28 which in the shown embodiment is formed as a two-stage pump. It drives the feeding element to perform a rotary movement.

The drive motor 20 and the feed pump 28 are enclosed by a multi-part housing 30 having several intermediate walls for separating a first chamber 32 accommodating the drive motor 20, a second chamber 34 accommodating the feeding element 26 of the second feed pump stage 40, and a third chamber 36 accommodating the feeding element 24 of the first feed pump stage 38.

The second feed pump stage 40 in the shown embodiments, is formed in a known manner as a flow pump stage, and in particular as a peripheral-side passage pump. Its feeding element 26 is formed as an impeller with vanes arranged on its periphery.

The ring-shaped passages 46 and 48 are formed in both housing walls 42 and 44 arranged at end sides of the impeller 26, and a suction opening 50 opens into the passage 46. The second feed pump stage 40 can be formed in a known manner as a displacement pump stage, for example as a rolling cell pump or as an inner toothed wheel pump. The first feed pump stage 38 is arranged before the second feed pump stage 40 as considered in the flow direction of the fuel and operates in accordance with the dynamic pressure principle.

The feeding element 24 of the first feed pump stage 30 is formed in the embodiment shown in FIG. 2–4 as an impeller provided with at least one feeding member 52 on its periphery. In the shown embodiment the feeding member is formed as a cup-shaped depression. In the first of the embodiment of the invention, two diametrically opposite feeding members 52 are provided so that the impeller 24 does not have imbalance. Depending on the required feeding quantity more than two feeding members 52 can be provided for avoiding an imbalance of the impeller 24 and uniformly distributed over its periphery. The depressions operating as the displacement members 52 are substantially U-shaped in their cross section, or in other words in a section perpendicular to the axis of rotation of the impeller 24. The U-shape is arranged substantially tangentially to the impeller in a lying position and extend with the ends of its length in a circumferential direction 53 of the impeller 24, so that the depression is opened in the circumferential direction 53. The in-flow region 54 in the depression 52 extends substantially spirally from a wall 55 of the impeller 24, which limits the depression 52 from outside and forms the outer leg of the U-shape, starting from its rotary axis. The in-flow region 54 is formed opposite to the rotary direction 53 of the impeller 24 on wall 55 of the depression 52 which is located outwardly the farthest so that no whirling is formed.

The depressions 52 are formed only in a central region 56 of the impeller 24, where its central region 56 in the direction of the rotary axis of the impeller 24 is limited by lateral, disc shaped portions 57. The lateral portions 57 have an outer diameter which is essentially the same as the diameter of the central region 56, so that the depression 52 are formed as channels in the central region 56 and laterally limited by the portion 57. The central region 56 and the lateral portions 57 can be formed as separate parts. In this embodiment the central region 56 is formed of one piece with the left portion 57 in FIG. 2, while the right portion 57 is formed as a separate part. Both parts can be connected with one another in any way. This multi-part construction of the impeller 24 has the advantage that despite the depression 52 no undercuts are formed and therefore the parts can be produced for example by injection molding of a synthetic plastic material. A three-part construction of the impeller 24 is also possible. In this case the central region 56 and both lateral portions 57 are formed as separate parts which are connected with one another. Two identical lateral portion 57 can be utilized, which can be especially simply designed.

The chamber 36 in which the impeller 24 is arranged is limited in direction of the rotary axis of the impeller 24 on the one side by a housing wall 58, and on the other side by a cover part 59. At its periphery the impeller 24 is surrounded by a substantially cylindrical housing part 16 provided with a plurality of openings 61 distributed over the periphery of the impeller 24 and connecting the chamber 36 with the fuel supply tank 10. A ring-shaped and closed feeding passage 62 is formed in the housing wall 58 in the end surface which limits the impeller 24. It is bridged by the lateral portion 57 of the impeller 24 and also sealed. It extends substantially at an identical radial distance from the rotary axis of the impeller 24 as the depression 52 in the central region 56 of the impeller 24. The feeding passage 62 is connected through at least one opening 63 extending from it with a hollow chamber 64 located between the housing walls 42 and 58. The suction opening 50 at the second feed pump stage 40 opens to the hollow chamber 64. An opening 65 is provided in the lateral portion 57 of the impeller 24 in the region of the depression 52 and forms a connection of the depression 52 with the feeding passage 62.

The end surface adjoining the impeller 52 is provided preferably with similarly with a ring-shaped closed passage 66 which is covered by the lateral portion 57 of the impeller 24. The lateral portion 57 adjoining the passage 66 also has an opening 67 in the region of the depression 52 for connecting the depression 52 with the passage 66. No fuel is available in the passage 66, but this passage serves for compensation of the pressure of the axial force acting on the impeller 24, which is available through the feeding passage 62.

A guiding grate 68 which is stationary relative to the impeller 24 is additionally arranged between the periphery of the impeller 24 and the cylindrical housing part 60. In the construction shown in FIG. 3 it has a plurality of radial vanes 69 with thoughgoing openings 70 providing between the vanes for feeding of fuel. The guiding grate 68 prevents the generation of the flow movement of the fuel surrounding the impeller 24 in the circumferential direction 53. The throughgoing openings 70 are substantially coaxial to the openings 61 in the cylindrical housing part 60. The vanes 69 of the guiding grate 68 reduce towards the rotary axis of the impeller 24 so that the throughgoing openings 70 expand toward the impeller 24. The guiding grate 68 in the first embodiment is formed as a separate structural part inserted in the cylindrical housing part 60. Alternatively, the guiding grate 68 can be of one piece with the cylindrical housing part 60, the cover part 59, or the housing part provided with the housing wall 58. In the variant shown in FIG. 4 the vanes 169 of the guiding grate 168 are inclined against the rotary direction 53 of the vanes 24.

During the operation of the fuel feeding aggregate 14, the impeller 52 of the first feed pump stage 38 is driven in the rotary direction 53 and feeds the fuel located in its depressions 52. Therefore a dynamic pressure effect is produced in the depression due to the circumferential speed of the depression 52 of the impeller 24. The thusly produced pressure increase can be calculated in a known manner by the following formula:

$$p=0,5\times\rho\times v^2,$$

wherein p- is dynamic pressure;

$\rho$ is a density of the fuel to be fed;

v is a peripheral speed of the depressions.

Since the fuel from the supply tank 10 enters the first feed pump stage 38 through the greater opening cross section of the openings 61 in the cylindrical housing part 60 and also greater throughgoing cross section of the guiding grate 68, the flow speed the fuel is very small. Therefore, the pressure in the region of the first feed pump stage 38 does not fall under the atmospheric pressure and therefore no gas bubbles are produced. The compressed fuel flows from the depression 52 though the openings 65 in the lateral portion 57 of the impeller 24 in the feeding passage 62 and from it through the openings 63 and the hollow chamber 64 to the suction opening 50 of the second feed pump page 40. Thereby the same pressure acts in the passage 66 as in the passage 62 on the impeller 24 with no resulting axial force.

A second embodiment of the fuel feeding aggregate of the invention is shown in FIGS. 5 and 6. Only structural elements which differ from those of the first embodiment will be explained herein below in detail. The feeding element 224 of the fuel feeding aggregate is formed as an impeller provided with two diametrically opposite feeding members 252 at each end side 257. The feeding members 252 are formed as depressions located in the end side 257. They are open in the circumferential direction 253 of the impeller 224 and covered in direction of the rotary axis of the impeller 224 by lateral walls 255, so that the depressions are cup-shaped. An in-flow region 254 is formed in the impeller 224 before the depression 252 as considered in the circumferential direction 253 of the impeller 224. It extends over a part of the circumference of the impeller 224 and deepens in a passage-like manner starting from the end side 257 in the impeller 224 up to the depression 252. The depressions 252 are arranged on the impeller 224 on a maximum possible radial to provide high peripheral speeds and thereby a high pressure increase by the dynamic pressure effect.

A cover part 259 adjoins limits the end side 257 of the impeller 224 which contains the depressions 252. In the region covered by the depression during the rotation of the impeller 224, the cover is provided with a plurality of openings 261 communicating with the depressions 252 with the supply tank 10. A ring-shaped closed feeding passage 262 is formed in the housing wall 258 which is opposite to the cover part 259 as in the first embodiment. The depressions 252 are connected with the feeding passage 262 through openings 265 in the impeller 224 and the feeding passage is covered and sealed by the facing end side 257 of the impeller 224. A guiding grate 268 is arranged between the cover part 259 and the end side 257 of the impeller 224 which contains the depression 252. Due to the guiding grate 268, similar to the guiding grate 168 of the first embodiment, the generation of drag flow of the fuel supplied to the impeller 224 is prevented. The vanes 269 of the guiding grate 268 extends substantially in the direction of the rotary axis of the impeller 224 or are inclined substantially against the rotary direction 253 of the impeller 224. Throughgoing openings 270 for the fuel are cornered between the vanes 269 of the guiding grate 268 and coincide with the opening 261 in the cover part 259. Therefore a favorable in-flow of the fuel from the supply tank 10 can be provided.

It will be understood that each of the elements described above, or two or more together, may also find a useful application in other types of construction differing from the types described above.

While the invention has been illustrated and described as embodied in an aggravate for feeding fuel from a supply tank to an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding fuel from a supply tank to an internal combustion engine of a motor vehicle, comprising a multi-stage feed pump including a pre-feeding pump stage and at least one subsequent feeding pump stage located after said pre-feeding pump stage as considered in a feeding direction, said pre-feeding pump stage having a rotatably driven feeding element provided with at least one feeding member formed as a depression which extends substantially in a rotary direction and is closed in a region which faces opposite to a rotary direction of said feeding element, said pre-feeding pump stage being formed so that it feeds fuel with the use of a dynamic pressure effect in said at least one feeding member, and said depression of said at least one feeding member being open in a rotary direction of said feeding element.

2. An aggregate as defined in claim 1; and further comprising a housing having a plurality of walls including one wall which limits said feeding element in direction of a rotary axis of the latter, said one wall having a ring-shaped feeding passage which is covered by an end side of said feeding element and connected with said subsequent feeding pump stage, said feeding element having an opening which connects said feeding member with said feeding passage.

3. An aggregate as defined in claim 2, wherein said housing has a further housing part which limits said feeding element at its end side located opposite to said feeding passage, said further housing part having an end surface adjoining said feeding element and provided with a ring-shaped passage, said feeding element having an opening which connects said feeding member with said passage.

4. An aggregate as defined in claim 1; wherein said feeding member is arranged on an outer periphery of said feeding element, and further comprising a substantially cylindrical housing part which surrounds the periphery of said feeding element and is provided with a plurality of openings which are distributed over the periphery and formed to connect the feeding member with a supply tank.

5. An aggregate as defined in claim 1; and further comprising a guiding grate which surrounds said feeding element on its periphery so as to hinder a tangential flow movement of fuel which surrounds said feeding element.

6. An aggregate as defined in claim 1, wherein said feeding member is a depression provided on the periphery of said feeding element and having a substantially U-shaped cross section, said depression being formed approximately tangentially on said feeding element.

7. An aggregate as defined in claim 6, wherein said feeding element is provided with an in-flow region located before said depression as considered in a rotary direction of said feeding element, said in-flow region extending substantially spirally relative to a rotary axis of said feeding element.

8. An aggregate as defined in claim 2, wherein said feeding element has a central region in which said feeding member is arranged and lateral disc-shaped portions including one disc-shaped portion which overlaps a feeding passage and in which said opening connecting said feeding member with said feeding passage is formed.

9. An aggregate as defined in claim 8, wherein said feeding element includes a plurality of parts which are separate from one another, at least said central region and one of said lateral portions being formed as said parts.

10. An aggregate as defined in claim 1, wherein said feeding member is arranged on an end side of said feeding element; and further comprising a housing part which limits said feeding element with said end side, said housing part being provided with a plurality of openings which connect said feeding member with a supply tank and are distributed over a periphery which is covered by said feeding member during rotation of said feeding element.

11. An aggregate as defined in claim 10; and further comprising a guiding grate provided between said end side of said element which has said feeding member and said housing part so as to hinder a tangential flow movement of the fuel supplied to the feeding element.

12. An aggregate as defined in claim 5, wherein said guiding grate is formed of one piece with said housing part.

13. An aggregate as defined in claim 11, wherein said guiding grate is formed of one piece with said housing part.

14. A feeding aggregate as defined in claim 11, wherein said feeding member is cup-shaped.

* * * * *